United States Patent [19]

Harris

[11] 4,143,845

[45] Mar. 13, 1979

[54] DETACHABLE SUPPORT MEMBERS

[76] Inventor: Mary A. Harris, 6443 Leighton, Lincoln, Nebr. 68507

[21] Appl. No.: 866,506

[22] Filed: Jan. 3, 1978

[51] Int. Cl.[2] ..... F16M 13/00

[52] U.S. Cl. ..... 248/221.2; 248/222.1; 248/302

[58] Field of Search ..... 248/112, 113, 220.3, 248/220.4, 221.1, 221.2, 222.1, 302, 303

[56] References Cited

U.S. PATENT DOCUMENTS

| | | | |
|---|---|---|---|
| 2,750,142 | 6/1956 | McKee | 248/222.1 |
| 3,037,733 | 6/1962 | Roman | 248/221.2 |
| 3,606,225 | 9/1971 | Rasmussen | 248/221.2 |
| 3,709,452 | 1/1973 | Feeny | 248/221.1 |
| 3,908,948 | 9/1975 | Hawthorne | 248/220.4 |

FOREIGN PATENT DOCUMENTS

| | | | |
|---|---|---|---|
| 2640423 | 3/1977 | Fed. Rep. of Germany | 248/221.2 |
| 1114701 | 9/1965 | United Kingdom | 248/221.2 |
| 1125060 | 8/1968 | United Kingdom | 248/220.4 |
| 1444525 | 8/1976 | United Kingdom | 248/221.2 |

*Primary Examiner*—William H. Schultz

*Attorney, Agent, or Firm*—Vincent L. Carney

[57] ABSTRACT

To support articles on a perforated vertical board, a first end of a wire hanger having a tapped hole in it is moved upwardly through a lower hole of the board until the tapped hole is aligned with an upper hole and it is fastened there by a screw threaded from the front of the panel, with a hook on the second end of the hanger extending from the front of the board to hold an article. Other embodiments that have ends fastened by a screw to the back of the board include: (1) a single wire having both ends bent parallel upwardly with holes in them and a center portion of the wire shaped to hold articles; (2) a plurality of wires, each of which has one end fastened to the board, the individual wires being joined by cross wires to form racks or horizontal shelves; and (3) a plurality of individual wires, each of which forms one support member of a plurality of support members for shelving, each wire having one end fastened to the board and the other end extending outwardly to form a top support surface terminating in a loop and then extending at an angle downwardly with a bottom shoulder abutting the perforated wall to form a bottom angular support.

12 Claims, 12 Drawing Figures

28A
24
20
18A
10
32A
14A
3
28B
26
34A
32B
14B
16
34B
12
30
3
22
18B
28C 36
48
46
44
40
32
14
38
47
42
34

24
28B
26
18A
36B
48B
32B
40B
44B
14B
38B
42B
30
47B
34B
30
12
30
18B 96
94
98A
98B
98C
98D
98E
100A
100B
100C
100D
100E
102A
102B
102C
102D
102E
104A
104B
104C
104D
104E
106A
106B
106C
106D
106E
108A
108B
108C
108D
108E
110A
110B
110C
110E
112
114A
114B
114C
120
122
124
126A
126B
126C
128
130A
130B
130C
132A
132B
132C
134A
134B
134C
136A
136B
136C
140A
140B
140C
142A
142B
142C
144A
144B
144C
146A
146B
146C
148A
148B
148C
150
130
132
134
136
140
142
144
146
148

DETACHABLE SUPPORT MEMBERS

This invention relates to support members for articles such as those that may be held by hooks or rest upon shelves or the like.

In one class of such support member, hangers formed of wire are detachably mounted to perforated boards. The perforated boards are adapted to be mounted vertically and have a matrix of holes through them forming rows and columns to receive the wire hangers through two vertically aligned holes. The wire hangers have an outwardly extending portion which serves to hold or support the articles.

In a prior art type of this class of support, the wire extends vertically across the front surface of the perforated board between two holes, which are engaged by either portions of the wire or by locking members.

The prior art type of supports have several disadvantages such as: (1) they are complicated and expensive in construction; (2) many of them are unable to be securely fastened to the perforated board; and (3) others are especially difficult to securely fasten from the front end of the board.

Accordingly, it is an object of the invention to provide a novel support member for articles.

It is a further object of the invention to provide a novel wire article support for mounting to perforated boards.

It is a still further object of the invention to provide a simple, economical wire support.

It is a still further object of the invention to provide a wire support having a positive fastening means at one location and stretching between at least two holes of a perforated board.

It is a still further object of the invention to provide an article support which is easily and firmly mounted to perforated boards to support articles on shelves or through apertures in the articles or between parallel members.

It is a still further object of the invention to provide a support having a section that extends through a first hole of a perforated board and up to a position where a tapped hole in its end is aligned with a second hole in the perforated board to receive a fastener for holding the support firmly in place and having another section which extends outwardly for supporting articles.

In accordance with the above and further objects of the invention, an article support includes a perforated board and wire hangers adapted to engage the perforated board to support articles by apertures in the articles or on shelving or between members of the wire hanger or the like.

One embodiment of article support includes a straight shank portion that extends upwardly through a first aperture in the perforated board with a flattened end portion having a tapped hole through it being aligned with a second aperture vertically above the first aperture in the board to receive a screw that holds the shank portion against the back surface of the board. An offset portion of the wire extends through the first aperture and forms a hook in front of the perforated board. The hook may be of various types such as a straight hook, swing hook, eyelet type hook or parallel eyelet hook — all formed of the same wire.

In another embodiment, each end of a single wire has an offset portion that extends through a different one of two side-by-side lower apertures in the perforated board to the back side of the board, with its shank portion extending upwardly along the back side. Each end has a flattened portion with a tapped hole in it to receive a screw for holding it to the board in a different one of two side-by-side upper apertures in the board. The wire between the two offset portions in front of the perforated board forms a serpentine section for shelving or forms a spring holder.

In still another embodiment, a plurality of wires, each has an offset portion that passes through a different one of a corresponding plurality of side-by-side holes in the board and extends upwardly abutting the back side of the board parallel to the other wires and terminating in a flattened end with a tapped hole in it aligned with a different one of a plurality of side-by-side apertures in the board to receive a screw for holding it against the back side of the board. The other end of each wire extends outwardly and is connected to the corresponding end of the other wires by one or more cross wires welded to them to form parallel members for supporting articles, shelving or to make wire shelving.

In still another embodiment, individual wires each form one of a plurality of separate support hangers for shelving, each having for this purpose one end with an offset member that passes through the board and extends vertically upward against the back of the board, terminating in a flattened section with a tapped hole to receive a screw. The other end of each wire extends in front of the board horizontally to support shelving and terminates in an upwardly extending loop with a downwardly and inwardly slanted arm extending back to the board in the same vertical plane and having at its end a shoulder abutting the front of the board and an inwardly extending ear passing through still another hole in the board to form still another support for the wire. A plurality of these members are positioned side-by-side horizontally to support shelving.

As can be understood from the above description, the hanger systems of this invention have the advantages of: (1) being economical because they are formed from a minimum number of inexpensive wires and standard screws; (2) being usable to hold types of different articles; (3) being mounted securely by a positive connection; and (4) being easily fastened together from the front of a perforated board.

The above noted and other features of the invention will be better understood from the following detailed description when considered with reference to the accompanying drawings in which.

Figure 1:
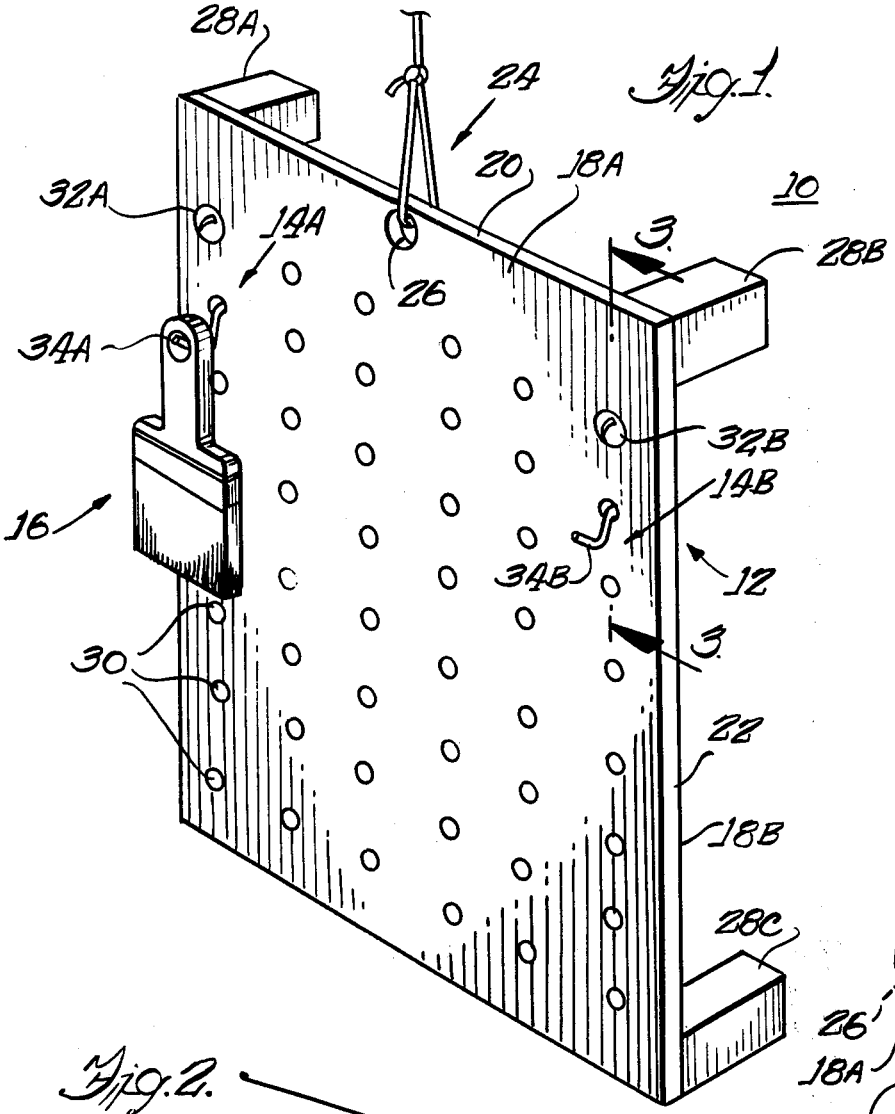
FIG. 1 is a perspective view of a perforated board with two wire hangers in it in accordance with an embodiment of the invention.

In FIG. 1, there is shown an article support 10 including a perforated board 12 and hangers, two of which are shown at 14A and 14B mounted to the perforated board 12. A small brush 16 is shown mounted on the hanger 14A to illustrate the use of the hanging system 10.

The perforated board 12 generally has the shape of a right-regular parallelepiped having: (1) front and back relatively-flat opposed parallel surfaces 18A and 18B, the front surface being shown at 18A; and (2) four narrow edges, two of which are shown at 20 and 22 in FIG. 1. For example, while the two large parallel surfaces such as 18A–B may be of any selected size, they are commonly three feet by three feet or the like in size whereas the edges such as 20 and 22 are commonly ⅛ of an inch or ¼ of an inch in thickness.

The perforated board 12 shown in FIG. 1 is supported in a vertical position by a cord 24 which passes through an aperture 26 in the board orthogonal to the surface 18A. It is spaced from a wall (not shown) by four feet, three of which are shown at 28A–28C extending from its corners in a direction orthogonal to the surface 18A. However, many other modes and equipment of and for mounting perforated boards are known and any of these may be used instead of the mode shown in FIG. 1.

To support the hangers 14 at different locations on the board, rows and columns of cylindrical holes 30 pass through the perforated board 12 in a direction perpendicular to the surface 18A. They may be of shapes other than cylindrical, organized into different patterns and have different sizes but commonly, the holes are ⅛ of an inch in diameter or ¼ of an inch in diameter and spaced from each other approximately one inch, center to center in two directions, forming a matrix of cylindrical holes. Boards of this general type are commercially available.

Only portions of the hangers 14A and 14B are shown in FIG. 1, which portions are the heads of screws shown at 32A and 32B and hook portions shown at 34A and 34B for two of the hangers 14A and 14B shown in FIG. 1 are mounted to the perforated board 12. As will be described more fully hereinafter, other portions of the hangers are mounted behind the perforated board 12 and other embodiments are possible which do not have the identical hook portions shown at 34A and 34B in FIG. 1. Moreover, the brush 16 shown hanging from one hanger at 14A is only illustrative and many other types of implements or articles may be mounted to the hanger system 10.

Figure 2:
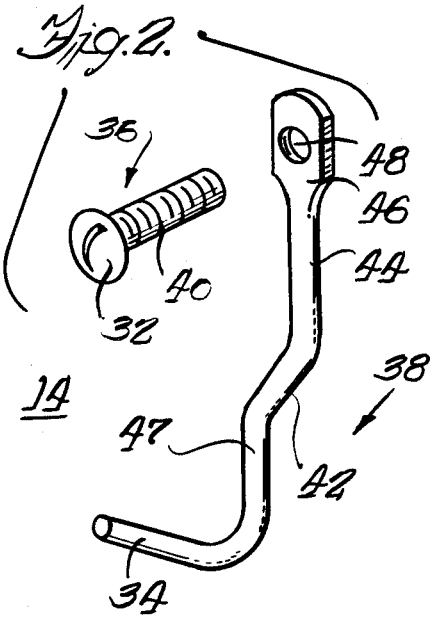
FIG. 2 is a perspective view of a portion of FIG. 1.

In FIG. 2, there is shown an exploded view of a disassembled hanger 14 of the type shown assembled in FIG. 1 at 14A and 14B. As best shown in this figure, the hanger 14 includes a screw 36 and a wire portion 38, with the screw 36 including a slotted head 32 and a threaded cylindrical shank 40 in a conventional manner. The wire portion 38 comprises an elongated wire having a hook portion 34, an offset portion 42, and a shank portion 44. At the distal end of the shank portion 44 is a flattened portion 46 having within it a tapped hole 48 of such a size that the internal threads mate with the external threads of the shank 40 of the screw 36. The flattened portion 46 has flat faces facing in the general direction of the offset portion 42 and hook portion 34.

Figure 3:
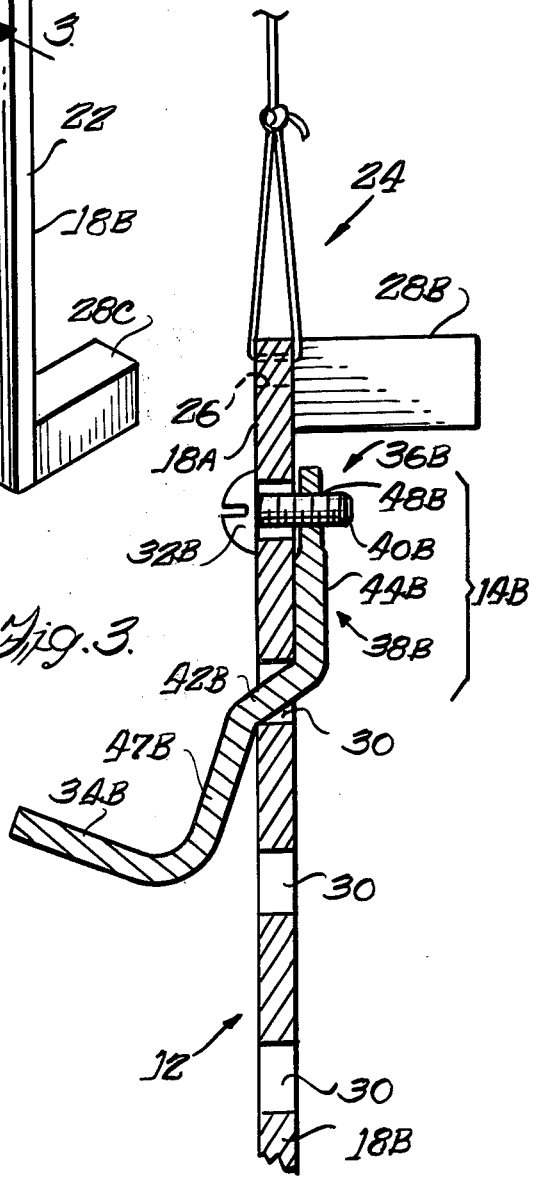
FIG. 3 is a sectional view taken through lines 3—3 of FIG. 1.

As best shown in FIG. 3, the hanger 14B is shown mounted to the perforated board 12 with the shank portion 44B behind the perforated board 12 against its surface 18B, the offset portion 42B extending at an angle through a cylindrical hole 30 between the shank portion 44B and a downward portion 47B of the hook 34B through an aperture in the board 12 and connecting at its opposite end to the hook portion 34B on the front surface 18A of the perforated board 12. The screw 36B has its head 32B extending on the outside of the board 12 against the front surface 18A and threaded cylindrical shank 40B engages the flattened end of the shank 44B through the tapped hole 48B on the back surface 18B of the board 12 to firmly fasten the hanger 14B in place.

While a screw 36B is shown as the fastener in FIGS. 1–3, it is obvious that other types of fasteners may be used. It is only necessary that the fastener be able to fasten the wire portion 38 of the hanger 14 to the back side 18B of the board 12. It is desirable that this fastening be possible from the front 18A of the board 12 as is the case with a screw. Screws also have the advantage of being economical since standard screws may be bought at a relatively low price.

To fasten a hanger such as the hanger 14B in place, the shank 44B of the hanger 14 is inserted through one of the cylindrical holes 30 in the perforated board 12 and moved upwardly until the angular offset portion 42B is within the hole 30. By looking through the hole above the one having the offset portion 42B in it while manipulating the hook portion 34B, the tapped hole 48B is aligned with the aperture 30 above the one having the offset portion 42B in it.

While the apertures 30 and 48B are aligned, the threaded shank 40B of the screw 36B is inserted through the hole in the perforated board 12 and threaded through the tapped hole 48B in the shank portion 44B of the hanger 14B, until the shank portion 44B is held against the back 18B of the board 12, with the head of the screw 32B being against the front 18A of the board 12.

As can be understood from the above description, the hanger system 10 of this invention has the advantages of being economical in price, easy to use and firmly fastening hangers in place. The hangers are economical because they use standard parts such as wires and screws and only require two such parts. They are easy to use because they permit fastening from only the front of the perforated board 12. The hangers are mounted firmly because of the positive connection by fasteners such as screws and because they are held at two points, one being a hole which receives the offset portion of the hanger and the other being the screw fastener.

Figure 4:
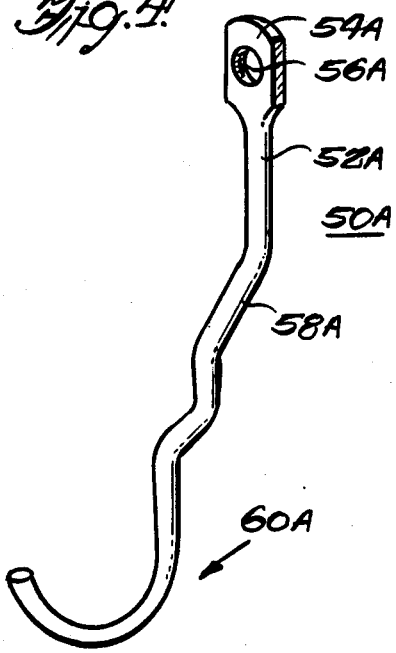
FIGS. 4, 5 and 6 are perspective views of wire hangers in accordance with other embodiments of the invention.
Figure 5:
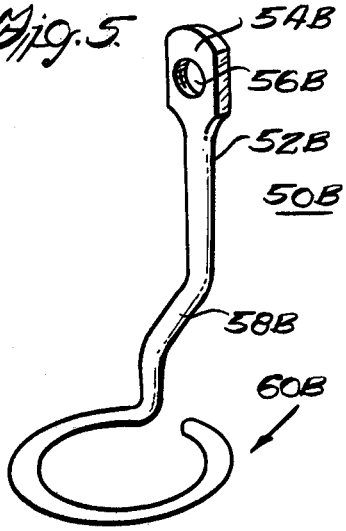
Figure 6:
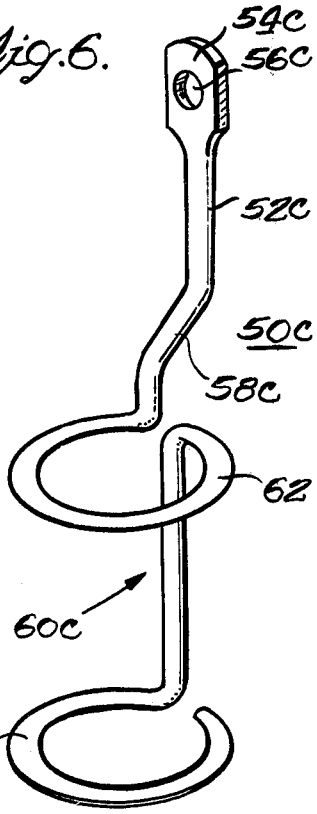

In FIGS. 4, 5 and 6, there are shown three other embodiments of hangers 50A, 50B and 50C respectively, each of which may be mounted at two points to a perforated board such as 12 (shown in FIGS. 1 and 3) in a manner similar to the hanger 14. Each of the hangers 50A–50C has a corresponding one of the straight shank portions 52A, 52B and 52C, a corresponding flattened end 54A–54C, a corresponding one of the tapped holes 56A–56C through corresponding ones of the flattened ends 54A–54C, a corresponding offset portion 58A–58C and a corresponding one of the hook portions 60A–60C.

The hangers 50A–50C are mounted in the same manner as the hanger 14 and differ from it only in the shapes of their respective hooks 60A–60C; the hook 60A being a sling hook rather than a straight hook 34 like that of hanger 14; the hook 60B is a single eye hook; and the hook 60C is a double eye hook having two eyelets 62 and 64 one under the other formed from the same piece of wire.

As can be understood from the above description, many different types of hooks such as hooks 60A–60C for mounting to a perforated board 12 may be formed from a single wire that is adapted to be fastened to the back side 18B of a perforated board 12. Each of these embodiments of hangers have similar advantages to the hanger 14.

Figure 7:
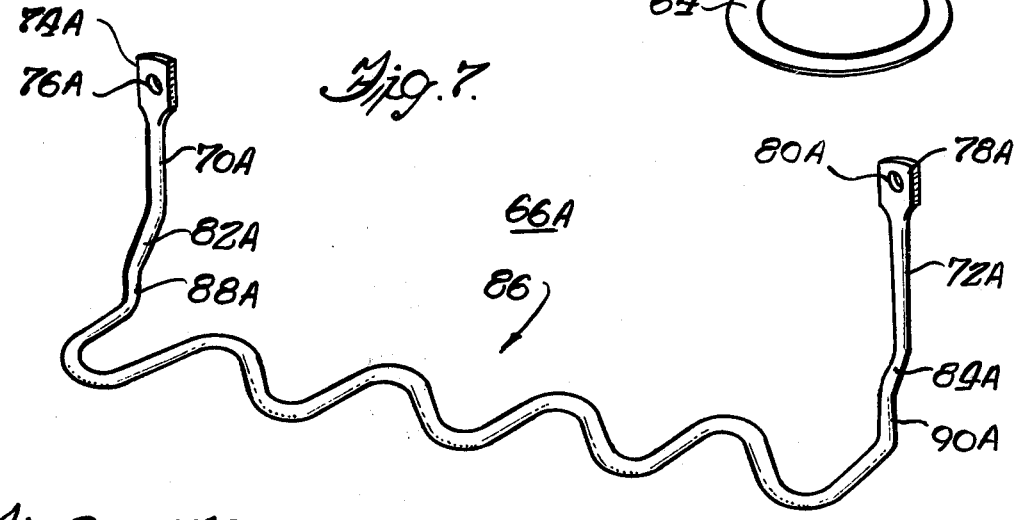
FIGS. 7 and 8 are perspective views of other wire hangers in accordance with other embodiments of the invention.
Figure 8:
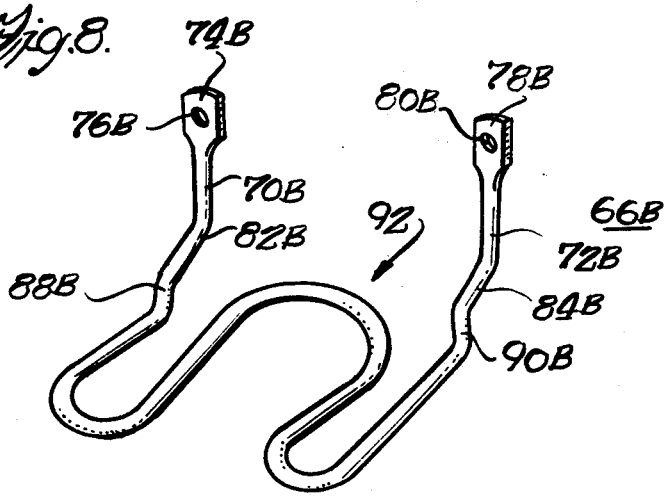

In FIGS. 7 and 8 there is shown two further embodiments of hangers 66A and 66B each of which is formed of a single integral wire formed to be fastened on the back side of a perforated board such as 12 (FIGS. 1 and 3) at a different pair of points by a different pair of fasteners that extend through apertures in the board.

For this purpose, the hangers 66A and 66B each have corresponding one of the first shanks 70A and 70B respectively at one end and second shanks 72A and 72B at the other ends. The shanks 70A and 70B each have a corresponding one of the flattenened portions 74A and 74B with corresponding tapped holes 76A and 76B therein and the shanks 72A and 72B each have at their distal ends corresponding ones of the flattened portions 78A and 78B respectively with tapped holes 80A and 80B respectively.

The shanks 70A, 70B, 72A and 72B, their flattened ends 74A, 74B 78A, 78B and tapped holes 76A, 76B, 80A, and 80B cooperate with the apertures in the perforated board 12 (shown in FIGS. 1 and 3) in the same manner as the corresponding shanks and apertured holes in the embodiments of FIGS. 1-6. However, in each of the embodiments 66A and 66B the respective tapped holes are aligned with apertures in the board along a horizontal line, with two screws fastening the holes in that position to form a double bond to the board 12 (shown in FIGS. 1 and 3).

To enable the article supporting portions of the hanger 66A to protrude from the front 18A of the board 12, offset portions 82A and 84A each extend from a respective one of the shanks 70A and 72A and are connected at their forward end to opposite sides of a rack portion 86 formed of a serpentine section of wire by corresponding ones of the vertical stems 88A and 90A respectively.

The serpentine section 86 includes curved or sign shaped sections horizontally formed to permit articles to be supported on top of them. Moreover, obviously a shelf may be positioned above the serpentine section 86 to horizontally support other items if desired.

To enable the article supporting portion of the hanger 66B to protrude from the front surface 18B of the board 12, offset portions 82B and 84B each extend through holes 30 from respective ones of the stems 70B and 72B and are connected at their other ends to opposite sides of a spring holder 92 by vertical stems 88B and 90B.

The spring holder 92 includes a horizontal integrally formed wire section extending horizontally outward from the vertical portions 88B and 90B and being looped inwardly to form a spring loop sized to receive implements such as the cylindrical barrels of flashlights or the like which may be snapped into the inner loop.

As can be understood, the embodiments of FIGS. 7 and 8 each include a single integrally formed wire member having: (1) two portions which may be attached by fasteners parallel to each other behind a perforated board; (2) two parallel offset portions extending through the board; and (3) an implement holder in front of the board to hold implements. They thus can be firmly mounted and provide article supports of types different from the embodiments of FIGS. 1-6.

Figures 9, 10, 11, 12:
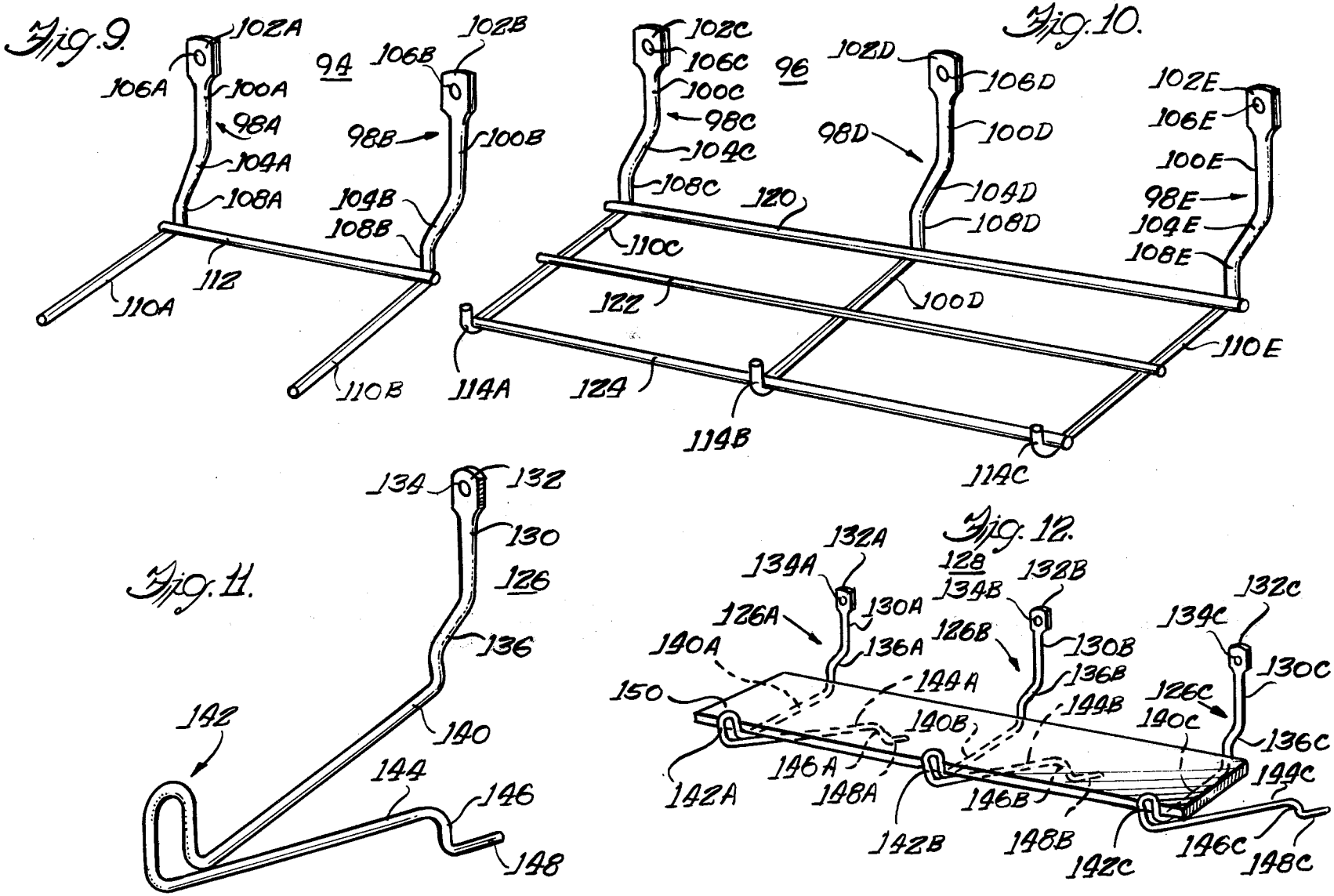
FIGS. 9 and 10 are perspective views of wire hangers in accordance with still other embodiments of the invention.
FIGS. 11 and 12 are perspective views of wire hangers in accordance with still another embodiment of the invention.

In FIGS. 9 and 10, there are shown two further embodiments of hangers 94 and 96 illustrating the use of a plurality of individual wires welded together to form a hanger. The embodiment 94 includes wires 98A and 98B and the embodiment 96 includes wires 98C, 98D and 98E.

Each of the wires 98A-98E have a corresponding one of the shank portions 100A-100E with a corresponding one of the flattened sections 102A-102E on one end and a respective one of the offset portions 104A-104E at the other end. Each of the flattened portions 102A-102E has a corresponding one of the tapped holes 106A-106E in it to receive a screw. These portions of the wires are adapted to fit behind a perforated board 12 (FIG. 1) in the manner of the other embodiments with the tapped holes 106A-106E being aligned with holes along a horizontal line in the perforated board 12 to receive screws with the offset portions 104A-104E extending through holes in the perforated board in the manner of the embodiments of FIGS. 1-8.

In front of the perforated board 12 (FIG. 1), the wires 98A-98E each include a corresponding one of five vertical downwardly extending sections 108A-108E which lie over the front surface 18A (shown in FIGS. 1 and 3) of the perforated board 12 and corresponding ones of the outwardly extending horizontal sections 110A-110E formed integrally at the bottom of the vertical downwardly-extending portions 108A-108E.

In the embodiment of FIG. 9, the horizontal outwardly-extending portions 110A and 110B may extend six or eight inches outwardly parallel to each other in a horizontal plane and be spaced apart from each other by three or four inches. The outwardly extending portions 110A and 110B are held together by a horizontal strut 112 welded at one end above the portion 110A and in front of the portion 108A and at its other end above the portion 110B and in front of the portion 108B near a bend in the wires from the vertical direction to the horizontal direction, thus joining the two wires 98A and 98B together at a location in front of the surface 18 of the perforated board 12.

The spacing of the portions 110A and 110B from each other and their lengths are selected to form a holder. Generally, an article having an enlarged portion at one end will be mounted to the hanger 94. For example, a broom may be mounted with the bristle portion above the horizontal members 110A and 110B with the handle extending between them.

In the embodiment 96, the wires 98C-98E each have a different one of three downwardly extending portions 108C-108E, horizontal outwardly-extending portions 110C-110E and upwardly extending ears 114A-114C. Each of the downwardly extending portions 108C-108E is integrally formed at one end to an end of a corresponding offset portion 104C-104E and at the other end to one end of a corresponding one of the horizontal members 110C-110E, the other end of the horizontal members 110C-110E being integrally formed with a corresponding one of the upstanding ears 114A-114C.

The vertical downwardly extending portions 108C-108E are intended to be mounted in front of the surface 18 of a perforated board 12 (shown in FIG. 1) with the horizontal portions 110C-110E each being parallel in a horizontal plane and terminating in a corresponding one of the upstanding ears 114A-114C to form a basic support portion of a shelf. Extending in a horizontal plane above the members 110C-110E and welded parallel to each other and orthogonal to the members 110C-110E to form three connecting members spaced apart from each other across the length of the members 110C–110E are three wires 120, 122 and 124. These members hold the wires 98C–98E spaced apart from each other at distances corresponding to the holes 106C–106E. With this arrangement, a convenient inexpensive shelf is formed.

In FIGS. 11 and 12, there is shown another embodiment of hanger 126, several of which are combined to form the embodiment 128 (shown only in FIG. 12).

As best shown in FIG. 11, the hanger 126 includes a downwardly extending shank portion 130 having a flattened end 132 with a tapped hole 134 in it and, at its opposite end, an offset portion 136 in a manner similar to the other embodiments. The tapped hole 134 and the offset portion 136 are adapted to coincide with holes in a perforated board 12 (FIG. 1).

At the front end of the offset portion 136 overlying the front surface 18A of the perforated board 12 is a downwardly extending portion of the wire integrally formed at one end with the offset portion 136 and at its other end with a horizontal outwardly-extending portion 140. The other end of the horizontal section 140 is looped upwardly at 142 and extends downwardly beneath the portion 140 at an angle in a vertical plane with the horizontal portion 140 and the loop 142 as shown at 144.

At the distal end of the section 144 is a downwardly extending portion 146 terminating in a horizontal section 140 positioned a distance beneath the offset portion 136 to extend through a perforation in the perforated board 12 (FIG. 1).

With this arrangement, the hanger 126 is supported at three points, one point being by means of a threaded fastener as shown in FIGS. 1–3 in the tapped hole 134, another at the perforation through which the offset portion 136 passes and a third at the perforation which receives the horizontal distal end 148. The distal end 148, while preferably being adapted to fit within a perforation so that the front surface 18 abuts the surface of the downwardly extending portion 146, may also be designed to rest against an unperforated surface, in which case, the distal end 148 must be flush with the back edge of the downwardly extending shank portion 130.

As shown in FIG. 12, three of the hangers 126A–126C of the type 126 are aligned on a perforated board and a shelf member 150 laid across them orthogonal to the horizontal members 140A–140C to form a shelf. With this arrangement, the number of members 126 necessary to form sufficient support may be used and the distance between them varied to accommodate different sized shelf boards 150.

Although the preferred embodiments of the invention have been described with some particularity, many modifications and variations in the preferred embodiments are possible within the light of the above teachings. Therefore, it is to be understood that, within the scope of the appended claims, the invention may be practiced other than as specifically described.

What is claimed is:

1. Apparatus for supporting articles from a perforated board, comprising:

an elongated member;

said elongated member being a wire;

a first portion of said elongated member being adapted to be fastened to the back of said perforated board at a selected first opening in said perforated board;

a second portion of said elongated member at an angle to said first portion being adapted to pass through a second opening in said perforated board;

a third portion of said elongated member forming a support structure, whereby articles may be supported on said board; and one end of said first portion of said elongated member having internal walls therein forming a tapped hole, whereby said one end may be fastened to the back of the perforated board with a screw.

2. Apparatus according to claim 1 further including:

a perforated board having a plurality of rows of holes therein; and at least one screw having its end abutting one side of said perforated hole and a threaded shank engaging the internal threads of said tapped hole.

3. Apparatus according to claim 1 in which said third portion is shaped as a hook.

4. Apparatus according to claim 1 in which said elongated member further includes:

a fourth portion passing through a third opening in said perforated board;

a fifth portion adapted to be fastened to the back of said perforated board;

said fifth portion including internal walls defining said tapped hole, whereby said fifth portion may be fastened by a screw to said perforated board.

5. Apparatus according to claim 1 in which said third portion is a spring holder.

6. Apparatus according to claim 1 in which said third portion is serpentine, whereby said third portion forms a rack.

7. Apparatus according to claim 1 in which said third portion includes:

a first horizontal section extending outwardly from said board;

a looped section at the distal end of said first horizontal section extending upwardly and downwardly;

a third section extending downwardly at an angle from said looped section to said board; and said first, second and third sections all lying in a vertical plane.

8. Apparatus according to claim 7 in which the distal end of said third section includes a downwardly extending portion abutting the front surface of said perforated board and a horizontal portion adapted to pass through an opening in said board.

9. Apparatus according to claim 1 comprising at least a second elongated member comprising:

a first portion adapted to be fastened to the back of a perforated board at an opening in the board;

a second portion adapted to pass through a second opening in said board;

a third portion forming a support structure, whereby items may be supported to said board;

said second elongated member being wire;

one end of said first portion having a flat section with internal walls defining a tapped hole, whereby said second elongated member may be fastened by a second screw to said board;

said third portion including a first horizontal section extending outwardly from said board, a second portion forming a loop extending upwardly and downwardly and a third portion extending downwardly and inwardly to a position abutting said board;

said first, second and third sections of said second elongated member lying in a vertical plane;

said third section of said second elongated member having an end extending downwardly against said board and inwardly through an opening in said board; and said first elongated member and second elongated member being adapted to be mounted to a board side by side with shelving positioned over them.

10. Apparatus according to claim 1 further comprising:

a second elongated member;

said second elongated member having a first portion adapted to be fastened to the back of a perforated board;

said first portion of said second elongated member having a flattened end with internal walls defining a tapped hole;

said second elongated member having a second elongated portion adapted to pass through another hole in said perforated board;

said second elongated member having a third portion forming a support structure, whereby items may be supported on said board; and cross members connecting said third portion of said first mentioned elongated member and said third portions of said second elongated member together at locations spaced so as to permit alignment of said tapped hole and said first elongated member and tapped hole and said second elongated member with vertically spaced openings in said perforated board.

11. Apparatus according to claim 10 in which said third portion of said first mentioned elongated member and said second elongated member having outwardly extending portions parallel to each other, whereby items may be supported with an enlarged portion above said parallel members and a narrower portion passing between said parallel members.

12. Apparatus according to claim 10 in which said third portions of said first mentioned elongated member and said second elongated member are joined by a plurality of parallel sections, whereby shelving is formed.

* * * * *